US009816271B2

(12) United States Patent
Dombowsky et al.

(10) Patent No.: US 9,816,271 B2
(45) Date of Patent: Nov. 14, 2017

(54) COMPOSITE FLOORING SYSTEM AND METHOD FOR INSTALLATION OVER SEMI-RIGID SUBSTRATE

(71) Applicants: Michael Dombowsky, Moose Jaw (CA); Ben Dombowsky, Moose Jaw (CA)

(72) Inventors: Michael Dombowsky, Moose Jaw (CA); Ben Dombowsky, Moose Jaw (CA)

( * ) Notice: Subject to any disclaimer, the term of this patent is extended or adjusted under 35 U.S.C. 154(b) by 0 days.

(21) Appl. No.: 15/182,814

(22) Filed: Jun. 15, 2016

(65) Prior Publication Data

US 2016/0369505 A1 Dec. 22, 2016

(51) Int. Cl.

| | |
|---|---|
| ***E04B 5/43*** | (2006.01) |
| ***E04B 1/00*** | (2006.01) |
| ***E04F 15/02*** | (2006.01) |
| ***E04B 5/02*** | (2006.01) |

(52) U.S. Cl.

CPC ..... *E04B 5/43* (2013.01); *E04B 1/003* (2013.01); *E04B 5/02* (2013.01); *E04F 15/02033* (2013.01); *E04F 15/02155* (2013.01); *E04F 15/02183* (2013.01); *E04F 2015/02066* (2013.01); *E04F 2201/07* (2013.01)

(58) Field of Classification Search

CPC ..... E04B 5/43; E04B 1/003; E04F 15/02183; E04F 15/22; E04F 15/02; E04F 15/02016; E04F 15/02033; E04F 15/02044; E04F 15/0215; E04F 15/02155; E04F 15/02435; E04F 15/02005; E04F 15/02441; E04F 2201/07

USPC ..... 52/263, 403.1, 411, 412, 480, 506.01

See application file for complete search history.

(56) References Cited

U.S. PATENT DOCUMENTS

| | | | | |
|---|---|---|---|---|
| 3,817,012 | A * | 6/1974 | Wack | E04F 13/0801 428/49 |
| 3,828,503 | A * | 8/1974 | Hofmann | A63C 19/04 52/390 |
| 4,388,788 | A * | 6/1983 | Bosco | E04C 2/12 52/390 |
| 4,546,024 | A * | 10/1985 | Brown | E04F 15/08 428/189 |
| 4,648,592 | A * | 3/1987 | Harinishi | A63B 6/00 428/17 |

(Continued)

FOREIGN PATENT DOCUMENTS

| | | | |
|---|---|---|---|
| JP | 10238087 | A * | 9/1998 |
| JP | 2001234626 | A * | 8/2001 |

*Primary Examiner* — Brent W Herring

(74) *Attorney, Agent, or Firm* — Shumaker, Loop & Kendrick, LLP

(57) ABSTRACT

A composite flooring system, and method of manufacture, including a multi-element flooring diaphragm including a plurality of self-spacing surface elements mounted above a semi-rigid substrate surface using a plurality of flexible adhesive support cushions that define an air space between the multi-element flooring diaphragm and the semi-rigid substrate surface, wherein outer edge surfaces of the self-spacing surface elements are beveled and flexible surface joints of v-shaped cross-section formed between abutting self-spacing surface elements, and wherein the combination of rigid or semi-rigid self-spacing surface elements and the flexible surface joints form a substantially waterproof diaphragm as a finished surface.

28 Claims, 14 Drawing Sheets

(56) References Cited

U.S. PATENT DOCUMENTS 4,698,249 A * 10/1987 Brown ..... E04F 15/08 428/189
5,111,627 A * 5/1992 Brown ..... E04F 15/024 52/126.5
5,205,091 A * 4/1993 Brown ..... E04F 15/024 52/126.6
5,243,799 A * 9/1993 Schluter ..... E04F 15/02027 52/282.1
5,365,710 A * 11/1994 Randjelovic ..... E04F 15/225 52/403.1
5,433,052 A * 7/1995 Niese ..... E04F 15/04 52/403.1
5,526,621 A * 6/1996 Shelton ..... E04B 1/7092 454/270
5,566,930 A * 10/1996 Niese ..... E04F 15/04 267/141.1
6,128,793 A * 10/2000 Weinstein ..... A47K 1/04 312/140.1
6,401,416 B1 * 6/2002 Ytterberg ..... E04B 1/6801 52/396.02
6,718,715 B2 * 4/2004 Elliott ..... E04F 15/225 52/403.1
7,096,631 B1 * 8/2006 Counihan ..... E04F 15/22 52/403.1
7,849,646 B2 * 12/2010 Harinishi ..... E04F 15/225 248/633
8,347,575 B2 * 1/2013 Bierwirth ..... E04F 15/182 181/284
2002/0108340 A1 * 8/2002 Elliott ..... E04F 15/225 52/403.1
2007/0266649 A1 * 11/2007 Overmyer ..... E04B 1/161 52/81.6
2009/0139172 A1 * 6/2009 Harinishi ..... E04F 15/225 52/403.1
2012/0055108 A1 * 3/2012 Bierwirth ..... E04F 15/182 52/403.1
2013/0152492 A1 * 6/2013 Whitaker ..... E04F 15/02 52/173.3

* cited by examiner

COMPOSITE FLOORING SYSTEM AND METHOD FOR INSTALLATION OVER SEMI-RIGID SUBSTRATE

CROSS-REFERENCE TO RELATED APPLICATION

This application claims priority from Canadian Patent Application No. 2,894,301 filed Jun. 16, 2015, the contents of which are incorporated by reference herein.

TECHNICAL FIELD AND BACKGROUND

The present invention relates in general to flooring and decking/patio systems, and more specifically discloses a system for the assembly of a composite flooring system with a multi-element flooring diaphragm comprised of a plurality of self-spacing surface elements which provides for enhanced water protection from damage to the substructure of the flooring system, as well as providing maximized flexibility in the multi-element flooring diaphragm so that the self-spacing surface elements can move independently under load. Effectively the installation of a flexible flooring layer on a flexible substrate results in a multi-element flooring diaphragm that is of high strength while also providing for flexibility on the surface enhancing comfort and load bearing characteristics.

In the construction of decking and floors a common approach is to build a wooden or metal frame upon which upon some form of decking material is then placed to provide a suitable surface upon for furnishings or the like to be placed, as well as which can be occupied by people. In some cases the decking surface can consist of wooden or composite planks attached to the underlying frame. In these cases, the planks are attached such that there is a small space between each plank to allow for expansion, and for water to be shed from the top surface of the deck.

A common problem with this type of decking system is that the substrate area under the deck is un-protected from moisture, and so the support structure is typically exposed to the elements an subject to degradation over time as a result. Where wooden joists are used, they can when contacted with water below any waterproof treatment or membrane decay. If a metal substrate surface is used, with screws placed therethrough etc., often times that will rust and the rusting of the substrate can again lead to a structural destabilization of the overall installation as well as potentially ruining the visible appearance of the product if the rust bleeds through. Wooden and even composite materials must be maintained over time in order to preserve both the structural integrity of the deck or patio, as well as to maintain aesthetic appearance. If it were possible to create a substrate for use underneath the deck or other flooring installation which was manufactured of materials that were resistant to most types of decay this would represent an enhancement over current available products.

Where the flooring layer is attached over top of a complete substrate layer, flooring tiles or similar flooring elements have in the prior art been attached by use of a complete layer of adhesive between the tile or substrate, or in other cases long beads of adhesive extending all the way from one end of the flooring surface or the like to the other end have been used. Both of these approaches have similar challenges in terms of their longevity—water entering into the adhesive layer cannot easily exit the structure, resulting in degradation of the overall flooring structure and rusting or decay of the substrate layer or structure. If it were possible to provide a means of horizontal membrane manufacture which would result in the ability to provide an integral membrane over a semi-rigid substructure, which would minimize the likelihood of long term structural decay from entry and lack of egress for water into the substrate and adhesive structure of such a multistructure floor, it is contemplated that this would be desireable.

One approach to solving the problem of water leaking through the surface of a deck has been to cover the decking with another material, such as a waterproof vinyl covering, or to use multiple layers of material to create an effective seal of the deck or patio surface (See for example Canadian Patent No. 2,601,599; Serino et al,). A limitation in these types of systems is that the additional layers increase the cost and complexity of manufacture of the decking.

Another one of the challenges to be addressed in the assembly of flooring structures of this type is the fact that the substrate layer, being the joist framework, floor or the like, is often not completely rigid and as such with some flexibility in the substrate the application of weight loads to the overall surface of the assembled floor causes flexing, torsion and cracking or breakage in the flooring surface or the grout joints which are exposed, which can further exacerbate the entry of water into the structure and the subsequent decay problems. If it were possible to develop a modified flooring system which could allow for the use of a semi-rigid substrate, while minimizing the possibilities of substrate degradation or decay, this would be seen as desireable in the art.

Another approach to the creation of a deck or floor installation, which can deal with the issue of water passage in many cases, is the installation of either a continuous poured layer of concrete or other cementitious material over a substrate. However in these types of cases the problem of a semi-rigid substrate layer can be appreciated by considering such a membrane installed on a flexible substrate. Given that the substrate—joist or the like—can flex under weight load, the application of a weight load to a traditional surface thereon can result in either the cracking of an integral membrane which does not accomodate flexing or torsion as loads move thereacross, or in other cases if joints are allowed to open between elements of the flooring surface, the loaded opening of those joints again can allow for the entry of significant quantities of water into the substructure of the floor—resulting again in the possibility of structural decay. In addition to prior art problems with the ingress of water below an attached flooring surface into the substrate in a floor installation, it would also be desirable to provide a system for the rapid deployment of a semi-rigid flooring substrate in a minimal amount of material and steps, to speed the overall assembly of decks or other floors. For example where a wooden joist structure is created, significant time is often required to cut and assemble the joist work and substrata beneath such an installation. Different types of brackets and other systems have been created to ease the creation to a degree the assembly of a flooring substrate, but if it were possible to address the issue of structural integrity and water egress from the substructure of a deck or floor with a subassembly that was rapidly and simply assembled this would also be considered desireable.

Providing a floor or horizontal surface that has some give in it as even the weight load of individuals walking thereacross is placed thereon has some comfort benefit as well—users of such a floor will notice that it does not have the same rigidity and may find it desireable to walk on such a floor. Again, however, the typical method of production of such a floor is the use of floating individual members or elements with joints therebetween, which again can result in the passage of fluid into the substructure.

BRIEF SUMMARY

The present invention comprises a composite flooring system and method of installation of same. The composite flooring system comprises a multi-element flooring diaphragm suspended above a substantially planar semi-rigid substrate surface with an air space between the multi-element flooring diaphragm and the semi-rigid substrate surface. The multi-element flooring diaphragm would be supported above the semi-rigid substrate surface by a plurality of flexible adhesive support cushions, which hold the multi-element flooring diaphragm in place and allows for flex and movement of individual self-spacing surface elements in the multi-element flooring diaphragm as they are weight-loaded, without the ability for water to pass through the overall membrane.

The composite flooring system of the present invention comprises a multi-element flooring diaphragm suspended above a semi-rigid substrate surface. The multi-element flooring diaphragm is made up of a plurality of self-spacing surface elements. Each of the self-spacing surface elements has an upper surface, which is the surface facing outward and representing the finished floor. The self-spacing surface element has an upper outer edge around its upper surface. The self-spacing surface element also has a lower surface, with a lower outer edge therearound.

The multi-element flooring diaphragm will be made up by aligning and abutting a plurality of self-spacing surface elements to each other, covering the desired semi-rigid substrate surface. It is generally speaking contemplated that the self-spacing surface elements will be rectangular in shape, although other shapes will be understood by those skilled in the art and all are contemplated within the scope of the present invention. The cutting of a plurality of self-spacing surface elements which are square or rectangualr in shape to overall cover a desired floor plate will be understood by those skilled in the art as well.

It is specifically contemplated that the self-spacing surface elements will be "self-spacing" in nature, enhancing the speed and accuracy of their installation. What is meant by "self-spacing" is the fact that the lower outer edges of the self-spacing surface elements will abut each other rather than needing to be spaced for the application of expansion joints or the like, resulting in the ability to most speedily and effectively assemble a complete multi-element flooring diaphragm.

In addition to the self-spacing surface elements being configured to allow for their "self-spacing" behaviour, for each lower outer edge of a self-spacing surface element which abuts a lower outer edge of an adjacent self-spacing surface element in construction of the completed multi-element flooring diaphragm, the outer edge surfaces extending from each said lower outer edge to the corresponding upper outer edge of the self-spacing surface element are beveled on an angle inwards towards the center of the self-spacing surface element, such that an adhesive joint channel with a v-shaped cross-section is created between the adjacent outer edge surfaces of the adjacently positioned self-spacing surface elements. The v-shaped adhesive joint channel allows for a further enhancement of the rapid depolyment, structural integrity and finished appearance of the multi-element flooring diaphragm.

Each of the self-spacing surface elements within the multi-element flooring diaphragm is supported on the semi-rigid substrate surface by a plurality of flexible adhesive support cushions, each of which adhesively engages the lower surface of the self-spacing surface element and the semi-rigid substrate surface, to flexibly support the self-spacing surface element above the semi-rigid substrate surface at the desired height to provide the predetermined and desired air space therebetween. The number of flexible adhesive support cushions used to support the self-spacing surface elements will be determined on an installation basis—in some materials or applications more or fewer flexible adhesive support cushions will be required and all such approaches are contemplated within the scope of the present invention.

The next element of the finished multi-element flooring diaphragm and composite flooring system of the present invention are flexible surface joints between all of the adjacent self-spacing surface elements. The flexible surface joints are comprised of flexible adhesive joint material injected or applied into each adhesive joint channel.

The flexible adhesive support cushions will allow for cushioned independent movement of each individual self-spacing surface element in the completed multi-element flooring diaphragm. As a weight load is placed on or moved across the multi-element flooring diaphragm, individual self-spacing surface elements can move up and down to the degree permitted by the flexible adhesive support cushions, which will then be resilient to allow for movement of that self-spacing surface element back into its normal resting position once the load is removed. The flexible surface joints will be waterproof, and will comprise flexible adhesive flexible adhesive joint material that will allow for side to side movement or other movement again of individual self-spacing surface elements without allowing entry of water into the air space between the multi-element flooring diaphragm and the semi-rigid substrate surface.

The flexible adhesive support cushions and the flexible surface joints will cooperate to allow for a multi-element flooring diaphragm which can respond, by permitting movement of individual self-spacing surface elements within the overall multi-element flooring diaphragm, to allow for flexibility—enhancing comfort and structural stability of the completed composite flooring system, without permitting water to pass through the multi-element flooring diaphragm into the substrate layer(s) of the composite flooring system.

The presence of the air space between the multi-element flooring diaphragm and the semi-rigid substrate surface provides two benefits. Firstly, the spacing of the multi-element flooring diaphragm some distance above the semi-rigid substrate surface allows for the independent element based flexibility of the multi-element flooring diaphragm above the substrate. Secondly, the air space coupled with the shape and positioning of the flexible adhesive support cushions allows for maximized ability for ingress of air below the multi-element flooring diaphragm, and maximized opportunity for egress of water from that area. The composite flooring system manufactured in this way effectively includes a drying layer.

The flexible adhesive joint material would make up the flexible surface joints—similar or different material might be used for the flexible adhesive support cushions. The flexible adhesive joint material might be colored to provide a visibly desireable finished appearance to the upper surface of the multi-element flooring diaphragm, or in other cases, following application of the flexible adhesive joint material into the adhesive joint channel between each pair of adjacent beveled and self-positioning edges of self-spacing surface elements, there might be other visual enhancement material applied to the tacky flexible adhesive joint material before it sets—for example colored grit or other material might be applied to make the flexible adhesive joint material appear more like cement or the like. Any type of a visual enhancement material is contemplated within the scope hereof.

Many different types of self-spacing surface elements and materials could be used within the scope of the manufacture of the composite flooring system and multi-element flooring diaphragm of the present invention, including ceramic tile, concrete, fiber-reinforced concrete, natural stone, or artificial stone. It is specifically contemplated that self-spacing surface elements made of fiber reinforced concrete might be beneficial, as they might add even further flexibility to the multi-element flooring diaphragm, but it will be understood that the method of the present invention could be practiced with self-spacing surface elements made of any different number of types of materials, all of which would not depart from the overall scope and intention hereof.

In addition to the multi-element flooring diaphragm and the flexible adhesive support cushions, the next mandatory element in the assembly of the overall composite flooring system of the present invention is the semi-rigid substrate surface. The semi-rigid substrate surface is the surface on which the remainder of the composite flooring system will be assembled. The semi-rigid substrate surface could either be a pre-existing surface capable of bonding to the flexible adhesive support cushions, or it could be a layer or surface implemented speicifcally for the purpose of practicing the remainder of the invention. In the ease of a pre-existing surface, the pre-existing surface could be a previously poured concrete surface, wood or metal surface, or any number of other types of surfaces on which it was desired to assemble the remainder of a composite flooring system in accordance with the present invention.

In other embodiments of the composite flooring system of the present invention, a sheet-type semi-rigid substrate surface or at least one sheet of substrate layer material could be installed as a precursor to the remainder of the assembly—for example a styrofoam, plastic, wooden, metal or other substrate could be added on top of a pre-existing surface, to provide a desireable semi-rigid substrate surface to begin the assembly of the remainder of the assembly of the composite flooring system.

It is also specifically contemplated that in certain embodiments of the composite flooring system of the present invention a specific modular substrate system which has been designed for use with the remainder of the present invention could be used. The modular substrate system could be any modular substrate system which could be easily assembled on an installation location for the composite flooring system of the present invention, which provided a substantially planar semi-rigid substrate surface.

In some embodiments of the present invention, the modular substrate system could be comprised of a plurality of substrate members which together formed a substrate layer—each of the substrate members could be a substantially U-shaped member having an upper surface, side surfaces and lateral flange portions, wherein each substrate member could form an elongate structure which was substantially rigid along a longitudinal axis while allowing for torsional flexibility around the longitudinal axis thereof. The bottom of the "U" shape of the substrate member could be flat—such that the upper surfaces of the substrate members, being the bottom of the "U", when assembled upside down would define the semi-rigid substrate surface.

The lateral flange portions, at the distal ends of the legs of the "U" shape in a "U" shaped substrate member, would provide support to the remainder of the substrate member, and would assist in holding each substrate member in a proper spaced apart parallel relationship to adjacent substrate members in the assembly of the complete modular substrate system—defining substrate channels therebetween.

The modular substrate system could either be assembled on a pre-existing surface which was rigid or non-rigid in nature, or could further include a support frame thereunder, potentially with risers to allow for the lifting of the height of the finished composite flooring system.

In addition to the composite flooring system itself outlined herein, there is also disclosed a method of construction of a composite flooring system comprising a multi-element flooring diaphragm suspended above a substantially planar semi-rigid substrate surface with an air space of a defined thickness therebetween. The multi-element flooring diaphragm is made up of a plurality of self-spacing surface elements. Each of the self-spacing surface elements has an upper surface, which is the surface facing outward and representing the finished floor. The self-spacing surface element has an upper outer edge around its upper surface. The self-spacing surface element also has a lower surface, with a lower outer edge therearound. In addition to the self-spacing surface elements being configured to allow for their "self-spacing" behaviour, for each lower outer edge of a self-spacing surface element which abuts a lower outer edge of an adjacent self-spacing surface element in construction of the completed multi-element flooring diaphragm, the outer edge surfaces extending from each said lower outer edge to the corresponding upper outer edge of the self-spacing surface element are beveled on an angle inwards towards the center of the self-spacing surface element, such that an adhesive joint channel with a v-shaped cross-section is created between the adjacent outer edge surfaces of the adjacently positioned self-spacing surface elements. The v-shaped adhesive joint channel allows for a further enhancement of the rapid depolyment, structural integrity and finished appearance of the multi-element flooring diaphragm.

The method itself comprises determining the placement of the plurality of self-spacing surface elements on the semi-rigid substrate surface, and applying a plurality of flexible adhesive support cushions to the semi-rigid substrate surface in positions effective to support the plurality of self-spacing surface elements above the semi-rigid substrate surface.

Following the placement of the plurality of flexible adhesive support cushions, the plurality of self-spacing surface elements would be positioned in relation to the semi-rigid substrate surface, with the lower surface of each of the self-spacing surface elements each adhesively engaging the flexible adhesive support cushions—the flexible adhesive support cushions supporting their respective associated placed self-spacing surface element above the semi-rigid substrate surface to define the air space. The lower outer edge of each pair of adjacent self-spacing surface elements would abut each other, creating the adhesive joint channels therebetween.

The next step in the method would be the placement of flexible adhesive joint material into the created adhesive joint channels, forming the flexible surface joints. Upon setting of the flexible adhesive support cushions and the flexible surface joints, individual self-spacing surface elements can move independently on the application of loads thereto without breaching the multi-element flooring diaphragm.

In some cases, removeable tape might be applied along the upper outer edges of the self-spacing surface elements in advance of the application of the flexible adhesive joint material into the adhesive joint channels, to minimize the application of flexible adhesive joint material to the upper surface of the self-spacing surface elements. The tape could be removed following formation of the flexible surface joints.

The flexible adhesive joint material might be colored to provide a visibly desireable finished appearance to the upper surface of the multi-element flooring diaphragm, or in other cases, following application of the flexible adhesive joint material into the adhesive joint channel between each pair of adjacent beveled and self-positioning edges of self-spacing surface elements, there might be other visual enhancement material applied to the tacky flexible adhesive joint material before it sets—for example colored grit or other material might be applied to make the flexible adhesive joint material appear more like cement or the like.

The self-spacing surface elements used in this method could be any self-spacing surface elements of any material described elsewhere herein.

In cases where the semi-rigid substrate surface comprises a modular substrate system as outlined elsewhere herein, the method might also comprise the step of assembly of the modular substrate system in advance of the application of the multi-element flooring diaphragm thereon.

The present disclosure describes components and methods of manufacture and installation of said components to provide a multi-element flooring diaphragm and composite flooring system. The present disclosure provides additional advantages in the multi-element flooring diaphragm described herein provide for the use of rigid decking materials arranged in such a way that the component cooperatively provide flexibility to the system. This provide for a more comfortable aesthetic experience when used, as well as allowing for the use of rigid surfacing materials such as tile or stone, as self-spacing surface elements while significantly reducing or eliminating the risk of cracking of the self-spacing surface elements of the decking. In addition, the self-spacing surface elements are fashioned to be self-spacing, and when finished with a flexible adhesive joint material operate to provide a substantially waterproof membrane overlying the decking substructures. The substructure is further designed to permit ingress of air and egress of water such that the growth of mold or mildew, or damage to supporting structures by water is effectively prevented.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

As outlined elsewhere herein, the present invention is in the field of a composite flooring system which allows for the installation of a multi-element flooring diaphragm on top of a semi-rigid substrate surface, with minimized likelihood damage or structural decay. Likelihood of damage is minimized both by providing an air space between the multi-element flooring diaphragm and the semi-rigid substrate surface, to allow for maximized egress of water from between those layers, as well as by providing a multi-element flooring diaphragm which is comprised of a plurality of self-spacing surface elements each able of independent floating movement in relation to the other self-spacing surface elements in the multi-element flooring diaphragm, allowing for movement, rather than breakage, under load when there is an uneven or flexible substrate below the multi-element flooring diaphragm.

Figure 1:
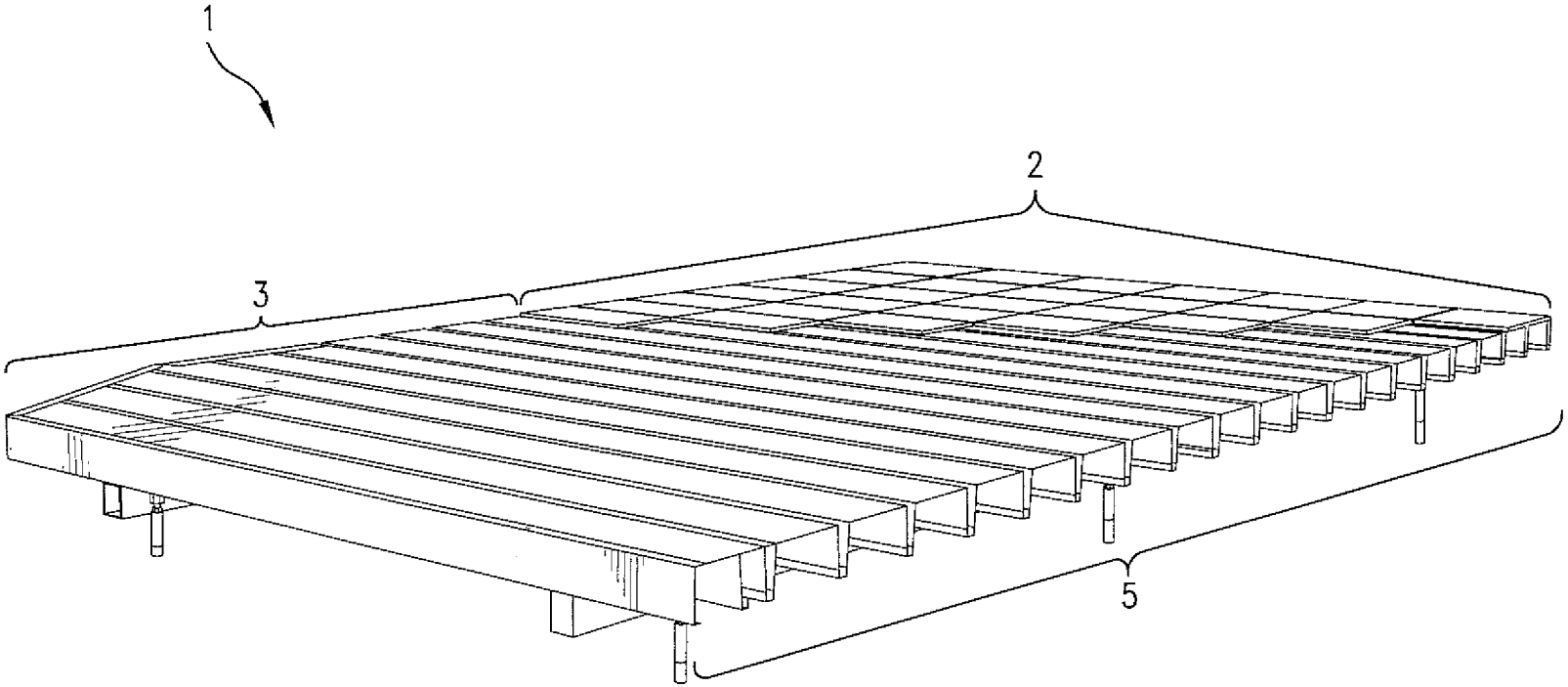
FIG. 1 is a cutaway perspective view of one embodiment of a composite flooring system in accordance with the present invention, wherein the semi-rigid substrate surface comprises a modular substrate system.
Figure 2:
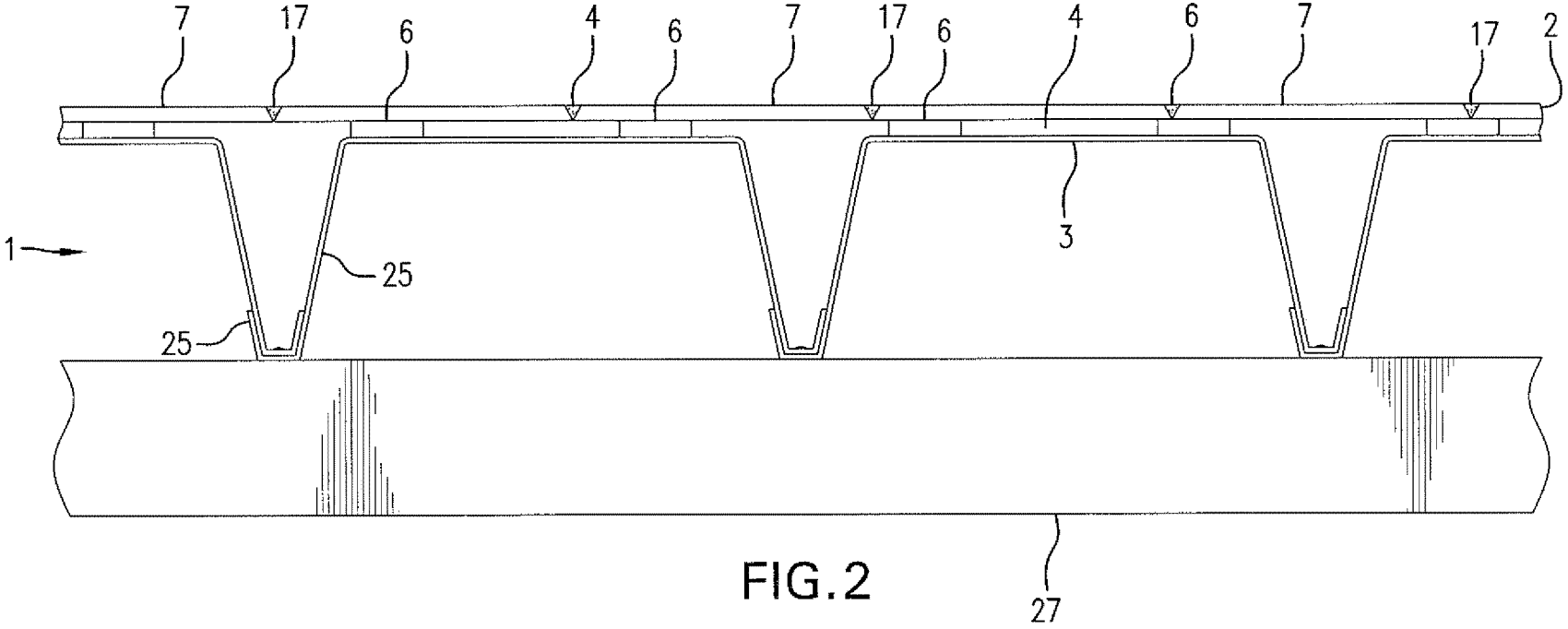
FIG. 2 is a schematic side view of a portion of the composite flooring system of FIG. 1, showing the layers in the completed installed composite flooring system.

Referring first to FIG. 1, there is shown a partial perspective view of one embodiment of a composite flooring system 1 in accordance with the present invention, which is intended to demonstrate the layers and components in the completed composite flooring system of the present invention. FIG. 2 is a cutaway side view of a portion of the embodiment of the composite flooring system I showing in FIG. 1, to demonstrate certain aspects of the invention in greater detail.

As shown in FIG. 1 and FIG. 2, there are three key layers to consider in the completed composite flooring system 1. The composite flooring system 1 comprises a multi-element flooring diaphragm 2 supported above a planar semi-rigid substrate surface 3. For ease of construction and in respect of other aspects of the invention outlined herein, the semi-rigid substrate surface 3 would allow for the use of available materials and wooden and similar substrata as are current understood in the art—without the added complexity and cost of creating a completely rigid substrate for use in the assembly of the composite flooring system 1 of the present invention. The semi-rigid substrate surface 3 accommodates movement of the multi-element flooring diaphragm 2, and vice versa, as the composite flooring system 1 is weight-loaded and unloaded during use. The multi-element flooring diaphragm 2 is mounted and separated from the semi-rigid substrate surface 3 by an air space 4, the air space 4 having a pre-determined thickness.

The air space 4 allows for water to exit from the substrate and structure of the composite flooring system I if it should penetrate the surface of the multi-element flooring diaphragm 2, or otherwise gain access to the underside of the multi-element flooring diaphragm 2 or the remainder of the substrate structure. Water will be able to exit the substrate and structure of the composite flooring system 1, and air will also be able to gain ingress access to the air space 4 for the purpose of aiding the drying of the structure of the composite flooring system 1 to minimize long-dwelling water presence and the possibility of structural decay. The pre-determined thickness of the air space could vary based upon the particular installation parameters or preferences of the designer or the project. An air space of any thickness, as can be accommodated by the size of the flexible adhesive support cushions and the remainder of the system and method of the present invention, are contemplated within the scope of the present invention.

The semi-rigid substrate surface 3 could comprises any number of different types of rigid or semi-rigid surfaces or structures, as will be outlined in further detail below. In the embodiment of this FIG. 1, the semi-rigid substrate surface 3 comprises the top facing surface of a modular substrate system 5.

The multi-element flooring diaphragm 2 is mounted to the semi-rigid substrate surface by a plurality of flexible adhesive support cushions 6. The use of a plurality of flexible adhesive support cushions 6 to support the multi-element flooring diaphragm 2 above the semi-rigid substrate surface 3 distinguishes the present invention from the prior art as well, since prior art methods of adhesive attachment of a multi-element flooring diaphragm such as a tile floor or the like have typically comprised direct adhesive attachment using either a single layer of adhesive across the entire semi-rigid substrate surface into which the surface elements or tiles are set, or a series of adhesive beads extending from one side of the semi-rigid substrate surface to the other. The use of the flexible adhesive support cushions 6 as shown provides an alternate and beneficial approach, as it provides for a full open air space between the multi-element flooring diaphragm 2 and the semi-rigid substrate surface 3, uninhibited by adhesive beads so that water can easily exit the structure of the composite flooring system 1. As well the benefit of the flexible adhesive support cushions 6 over a complete adhesive layer between the multi-element flooring diaphragm 2 and the semi-rigid substrate surface 3 includes the fact that the elements of the multi-element flooring diaphragm 2 have more uninhibited freedom to move independently in response to weight loading, and the complete layer of adhesive or adhesive beading approaches also provide more likelihood for the stranding of fluid pockets within the strata of the completed structure of a composite flooring system which can contribute to more rapid degradation of the substrate or other structure. The sizing or number of flexible adhesive support cushions 6 which would be used can vary by project or installation, but the concept of isolated pylons or cushions 6 allowing for compressible movement of individual elements in the multi-element flooring diaphragm 2 without the possibility for lodging of fluid pockets thereunder between beads or in a complete adhesive layer will be understood by those skilled in the art and the number or size of the flexible adhesive support cushions will be understood to be a design choice all of which is within the scope of the claimed invention.

These flexible adhesive support cushions 6 serve to create an air space 4 between the self-spacing surface elements 7 and the semi-rigid substrate surface 3 so as to allow the flow of air into the air space 4, and the flow of water out of the space and out from between the multi-element flooring diaphragm 2 and the semi-rigid substrate surface 3 upon which the multi-element flooring diaphragm 2 has been installed. In some embodiments, the flexible adhesive support cushions 6 are formed from a resilient elastomeric material such that they will be able to deform to a desired extent when a load is applied to an overlying surface element, and then to return to substantially their original shape when the load is removed.

Preferably, the flexible adhesive support cushions 6 are both resilient and adhesive such that they maintain self-spacing surface elements 7 in the desire position, as well as allowing deformation of the multi-element flooring diaphragm 2 in response to the application of a load. Depending on the expected loading of the multi-element flooring diaphragm 2, fewer or greater numbers of flexible adhesive support cushions 6 may be employed. By varying the spacing of the flexible adhesive support cushions 6, a multi-element flooring diaphragm 2 can be designed to accommodate a pre-determined surface loading per unit area prior to assembly. In some cases it will be preferable to have the flexible adhesive support cushions 6 pre-installed on the substrate members at the point of manufacture, in order to save time and expense during assembly of the composite flooring system. It will be appreciated that for maximal effectiveness of the flexible adhesive support cushions 6, in some cases it will be preferable that the substrate members and self-spacing surface elements will have pre-existing surfaces that are capable of bonding to the flexible adhesive support cushions 6.

The adhesive material of manufacture of the flexible adhesive support cushions 6 would be an adhesive material which is elastic or elastomeric when it is set and is capable of adhering to the semi-rigid substrate surface 3 as well as adhering to the lower surface of the multi-element flooring diaphragm 2 defined by the lower surface of the self-spacing surface elements. The flexible adhesive support cushions 6 when the adhesive material is set need to be deformable or resilient in character, such that they can deform or compress when the overlying self-spacing surface element is loaded with weight, and will be resilient insofar as expanding back to its regular position and profile, supporting the multi-element flooring diaphragm 2 at the defined thickness of the air space 4. Any number of types of adhesive material will be understood as options by those skilled in the art of construction and assembly of these types of products, and any type of a polymeric or other adhesive matter which is capable of providing the adhesion and deformability and resiliency required will be understood to be within the scope of the present invention.

Figure 3:
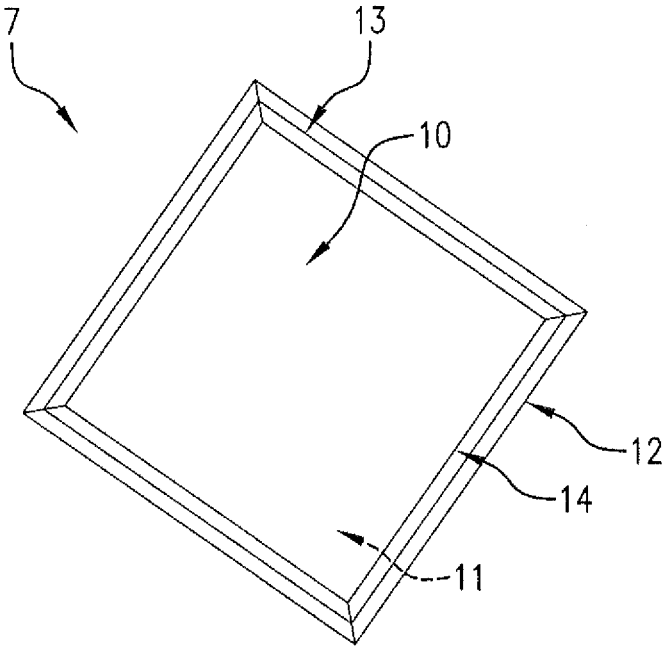
FIG. 3 is a perspective view of one embodiment of a self-spacing surface element in accordance with the present invention.

The multi-element flooring diaphragm 2 further comprises a plurality of self-spacing surface elements 7—in the completed composite flooring system 1 the plurality of self-spacing surface elements 7 can each move independently in relation to adjacent self-spacing surface elements 7 when weight-loaded, so that the likelihood of structural breach or cracking of the multi-element flooring diaphragm 2 is minimized. FIG. 3 is a perspective view of one embodiment of a self-spacing surface element 7 in accordance with the present invention. The self-spacing surface elements 7 are tiles or hardscape elements which are used to create a flooring layer. Arrangement of the plurality of self-spacing surface elements 7 in a pattern creates the multi-element flooring diaphragm 2. As outlined below, the self-spacing surface elements 7 can be arranged in multiple types of geometric patterns.

Each self-spacing surface element 7 will have an upper surface 10 and a lower surface 11. The outer circumference or edge of the lower surface 11 is the lower outer edge 12. The outer circumference or edge of the upper surface is the upper outer edge 13. The key aspect of the design of the self-spacing surface element 7 which allows for its "self-spacing" character, allowing for the rapid installation of the multi-element flooring diaphragm 2, is the fact that the outer edge surfaces 13 of the self-spacing surface element 7 are beveled inwards from the lower outer edge 12 to the upper outer edge 14, towards the centre of the upper surface. The bevelling of the outer edge surfaces 13 allows for the lower outer edge 12 of a self-spacing surface element 7 when installed by abutting placement against an adjacent self-spacing surface element 7 allows for the quick placement of the entire plurality of self-spacing surface elements in the multi-element flooring diaphragm 2 without the need to use spacers to create uniform adhesive joint spacing between the adjacent self-spacing surface elements 7. The amount of the inward bevel of the outer edge surfaces 13 of the self-spacing surface element 7 will equate to one half of the width of the adhesive joint channel which will be defined between adjacent self-spacing surface elements 7.

The inward angle bevelling of the outer edge surfaces 13 of the self-spacing surface elements 7 will result in the creation of adhesive joint channels between adjacently placed and abutting self-spacing surface elements 7 that have a v-shaped cross-section. The v-shaped cross-section of the adhesive joint channel is a key aspect of the present invention. The v-shaped cross-section of the adhesive joint channel allows for the injection or placement of a significant amount of flexible adhesive joint material into the adhesive joint channel with maximum amount of surface area on the outer edge surfaces of each adjacent self-spacing surface element to contact the flexible adhesive joint material, allowing for the creation of the strongest flexible surface joints.

The self-spacing surface elements 7 could be of multiple shapes and sizes. It is contemplated that the likely shapes would be rectangular (or square) which would allow for the creation of multi-element flooring diaphragm patterns in many flooring applications. Rectangular or square self-spacing surface elements would be well understood by those skilled in the art of flooring, tiling and hardscaping. The self-spacing surface elements can also be cut to size to yield a multi-element flooring diaphragm which can be installed in place in a location or footprint of many shapes and sizes.

The self-spacing surface elements 7 would be rigid or semi-rigid materials—for example, wood, concrete, metal, ceramic, cement or other types of materials. The rigidity of the material of the self-spacing surface elements is key to the operation of the composite flooring system 1 in aggregate—semi-rigid or rigid self-spacing surface elements are key to the finished appearance and behaviour of the composite flooring system 1, and the rigid multi-element flooring diaphragm 2 which is created by the plurality of self-spacing surface elements 7 created by the self-spacing surface elements 7 of this type of material will be enhanced insofar as the floating nature of the individual self-spacing surface elements will mines the likelihood of breakage or breach of the multi-element flooring diaphragm 2. It is specifically contemplated that the self-spacing surface elements 7 could be made of a ductile concrete material including fibre-reinforced concrete, or any other type of material which was rigid or semi-rigid.

Figure 4:
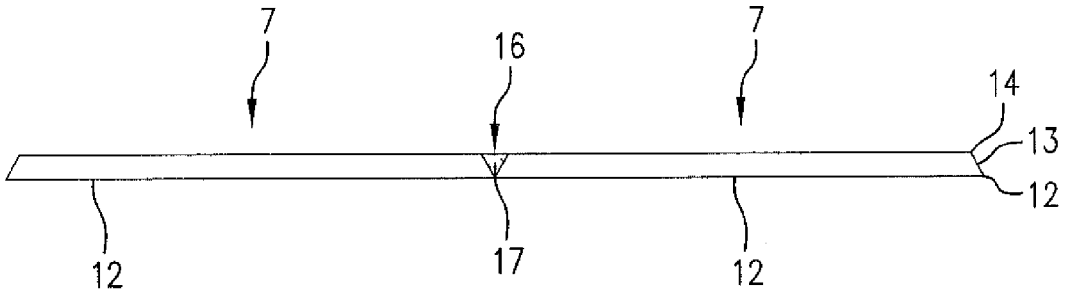
FIG. 4 is a cutaway side view of one embodiment of a flexible surface joint in a completed composite flooring system of the present invention, using self-spacing surface elements as shown in FIG. 3.

FIG. 4 is a cross-sectional view of one embodiment of two adjacent self-spacing surface elements 7 to demonstrate one approach to the inward bevelling of the outer edge surfaces 13 of the self-spacing surface elements 7. In the case of this Figure and this embodiment, the outer edge surfaces are beveled inwards starting right at the lower outer edge 12 reaching upwards to the upper outer edge 14 of the self-spacing surface element 7. The formed adhesive joint channel 17 can be seen between the two adjacent self-spacing surface elements 7, being a v-shaped cross-section reaching up from a point at the base of the self-spacing surface elements 7. Placement of the flexible adhesive joint material 16 into the adhesive joint channel 17 results in a flexible surface joint 18 on the surface of the multi-element flooring diaphragm 2.

Figure 5:
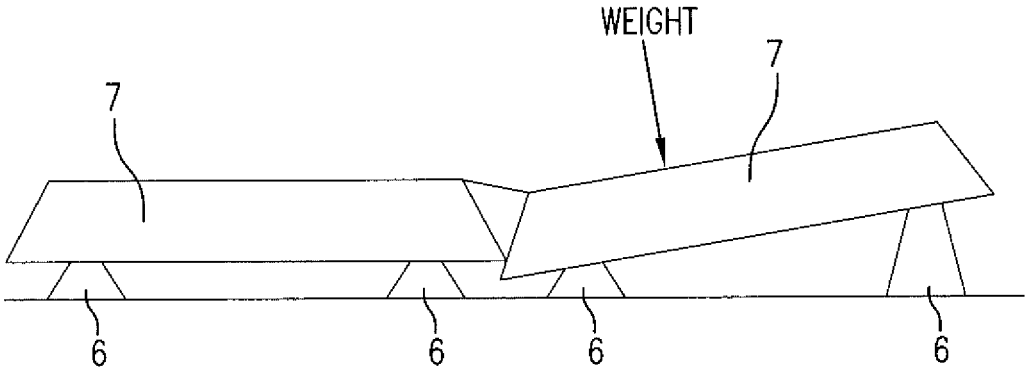
FIG. 5 is a view of the embodiment of FIG. 4, with weight load being placed on one of the self-spacing surface elements, to demonstrate the behaviour of the flexible adhesive support cushions and the flexible surface joints.

FIG. 5 demonstrates the embodiment of the flexible surface joint of FIG. 4 and its behaviour upon the application of a weight load to one of the self-spacing surface elements 7 joined by a particular flexible surface joint. Compression of the flexible adhesive support cushion beneath the self-spacing surface element 7 on the right of the Figure, and the stretching of the related flexible surface joint, to allow for the temporary deformity or independent movement of the self-spacing surface elements 7 in the multi-element flooring diaphragm 2.

Figure 6:
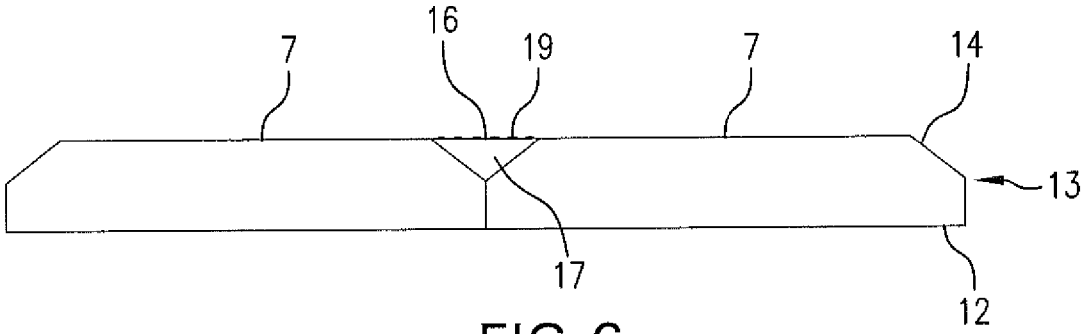
FIG. 6 is a cutaway side view of an alternate embodiment of the flexible surface joints of the present invention.

FIG. 6 is a cross-sectional view of another embodiment of two adjacent self-spacing surface elements 7 to demonstrate another approach to the inward bevelling of the outer edge surfaces 13 of the self-spacing surface elements 7. In the case of this Figure and this embodiment, the outer edge surfaces are beveled inwards starting partway up the outer edge surfaces, reaching upwards to the upper outer edge 14 of the self-spacing surface element 7. The formed adhesive joint channel 17 can be seen between the two adjacent self-spacing surface elements 7, being a v-shaped cross-section reaching up from a point partway up the side wall of the self-spacing surface elements 7. Placement of the flexible adhesive joint material 16 into the adhesive joint channel 17 results in a flexible surface joint 18 on the surface of the multi-element flooring diaphragm 2. In this case, visual enhancement material 19—namely simulated grout or grit material, is also shown.

The flexible adhesive joint material 16 which is used to form the flexible surface joints 17. The flexible adhesive joint material 16 might be the same material used for forming the flexible adhesive support cushions, or it might be a different type of material The flexible adhesive joint material could be any type of a strong and flexible adhesive which will maintain its adhesion to the outer edge surfaces of the adhesive joint channel when a weight load is placed on the related self-spacing surface element. The end result is that individual self-spacing surface elements 7 are capable of independent movement upon the application of various loads to the upper surface of the multi-element flooring diaphragm 2, without breaching the surface integrity of the multi-element flooring diaphragm 2.

The next element of the composite flooring system 1 shown in FIG. 1 and FIG. 2 is a substrate structure used to construct the semi-rigid substrate surface 2. The modular substrate system 20 is assembled from a plurality of substrate members 21, arranged to form a semi-rigid substrate surface 3 onto which the multi-element flooring diaphragm 2 can be installed. The modular substrate system 20 shown in this Figure comprises a plurality of elongate substrate members 21 configured to cooperatively form a semi-rigid substrate surface 3 upon which to install the multi-element flooring diaphragm 2. Preferably, each substrate member 21 is fashioned as a U-shaped elongate structure having a substantially flat upper surface 22, side surfaces 23 that meet the upper surface in upper edges 24, and lateral flange portions 25 at least at the distal ends 26 of the side surfaces 23. The lateral flange portions 25 extend for substantially the entire length of the substrate member 21. As shown in FIG. 2, the lateral flange portions 25 are configured such that the flange of one substrate member 21 can engage the lateral flange portions 25 of an adjacent substrate member 21. This provides for increase stability in the planar semi-rigid substrate surface 3 formed by the substrate members 21, and to maintain substrate members 21 in a generally parallel arrangement. In addition, the substrate members 21 are formed such that when engaged with each other, they form a series of substrate channels 26 at regularly spaced distances across the semi-rigid substrate surface 3. The U-shape of the substrate members 21 also provides that each substrate member 21 is substantially resistant to bending longitudinally, while be torsionally flexible around the longitudinal axis of the substrate member 21.

In some instances it may be desirable to secure the substrate members 21 to an underlying support frame 27, as depicted.

Figure 7:
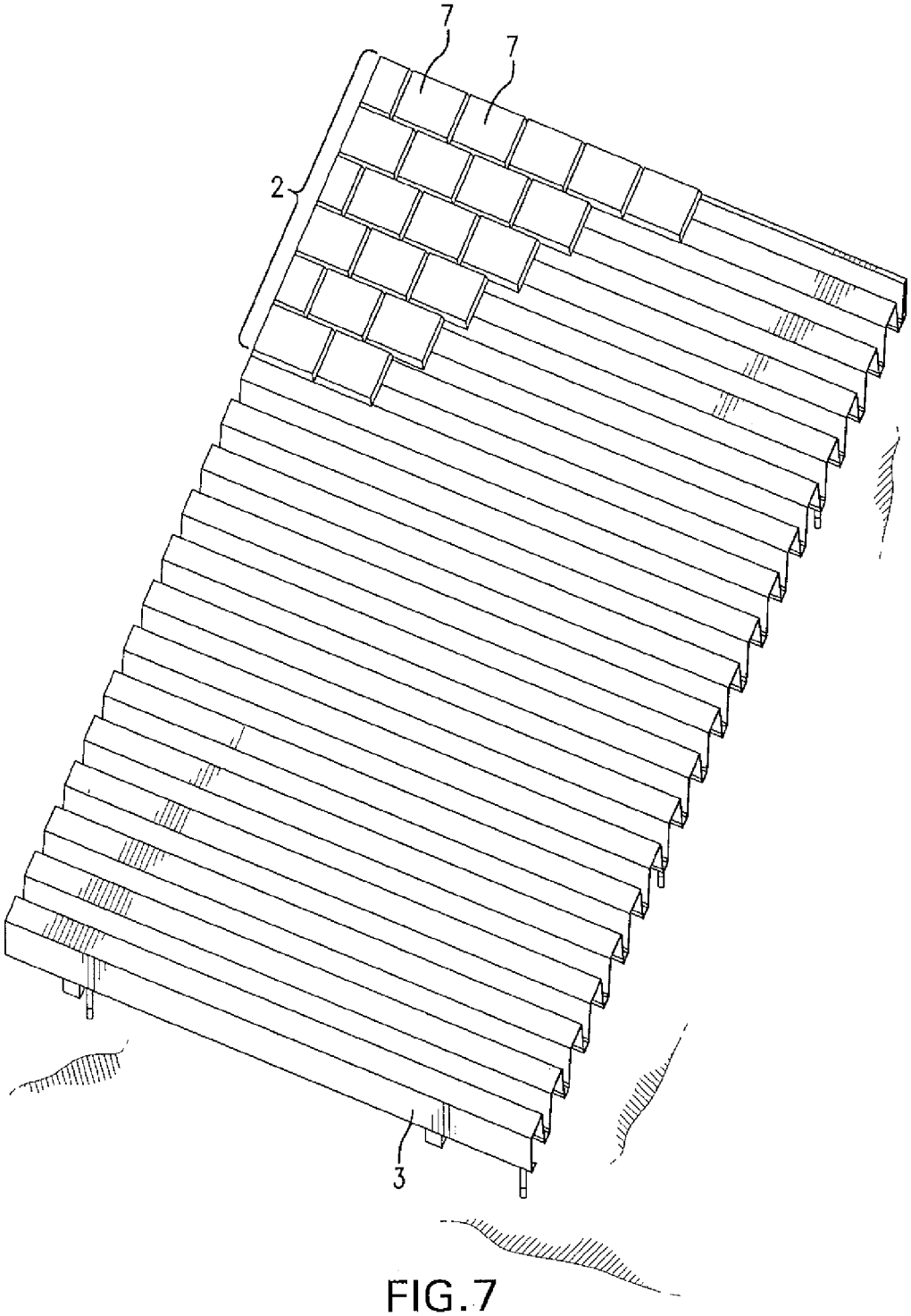
FIG. 7 is a cutaway perspective view of another embodiment of a composite flooring system, wherein the semi-rigid substrate surface comprises an at least one sheet of substrate layer material.
Figure 8:
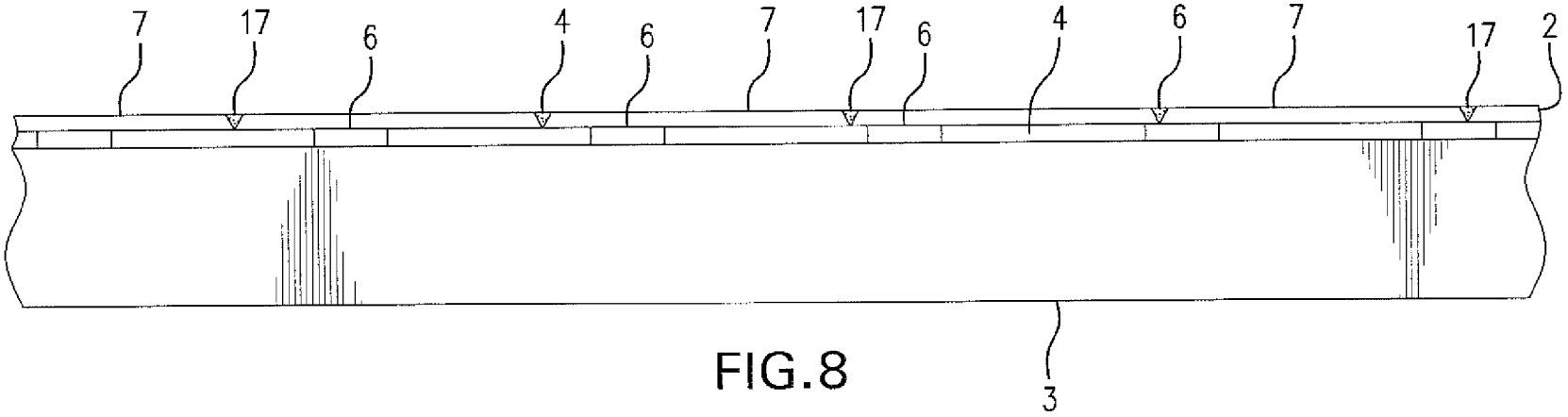
FIG. 8 is a cross-sectional side view of a portion of the composite flooring system of FIG. 7.

FIG. 7 demonstrates a cutaway perspective view of an alternate embodiment of the composite flooring system of the present invention in which the semi-rigid substrate surface comprises at least one sheet of substrate layer material, rather than a modular substrate system as outlined in the embodiment of FIG. 1. FIG. 8 is a side cutaway view of a portion of the embodiment of the composite flooring system shown in FIG. 7. In this case, the installation of the remainder of composite flooring system 1 using a semi-rigid substrate surface which comprised at least one sheet of substrate layer material 30 which was a sheet of semi-rigid construction material, for example a sheet of styrofoam on a ground surface etc.

Returning to the assembly and configuration of the multi-element flooring diaphragm 2, once the self-spacing surface elements 7 are self-indexed into position as desired on the semi-rigid substrate surface 3, the adhesive joint channels formed between adjacent self-spacing surface elements 7 can be filled with a flexible adhesive joint material to form the flexible surface joints that are operative to permit movement of individual self-spacing surface elements 7 relative to the plane of the flooring surface. In some cases it will be advantageous that the flexible adhesive joint material be waterproof, such that in combination with the self-spacing surface elements 7 a contiguous flooring surface that is resistant or impervious to water is formed. For aesthetic purposes, it may also be desirable to finish the flexible adhesive joint material with a visual enhancement material that comprises a grit material in order to simulate the appearance of cementitious grout joints as would be used in traditional tile floor systems. The placement of visual enhancement material on a flexible surface joint is shown in FIG. 5.

There are a number of different patterns for the placement of the self-spacing surface elements in the creation of the multi-element flooring diaphragm, dependent upon the desired finished appearance for the multi-element flooring diaphragm as well as the shape of the self-spacing surface elements. It is anticipated for example that in most embodiments of the present invention the self-spacing surface elements would be either square or rectangular in shape—installers of tile and other flagstones and hardscaping are used to creating different visual patterns with these shapes and it will be understood that the specific pattern of placement of the self-spacing surface elements in the multi-element flooring diaphragm is encompassed regardless of the pattern chosen—so long as within the flooring area to be covered there was a spacing and anticipated configuration of the self-spacing surface elements which is desired by the user, all such approaches can be achieved without departing from the scope or intention herein. As the pattern for placement of the self-spacing surface elements was changed, the placement of the flexible adhesive support cushions on the semi-rigid substrate surface might need to be modified as well.

Figure 9:
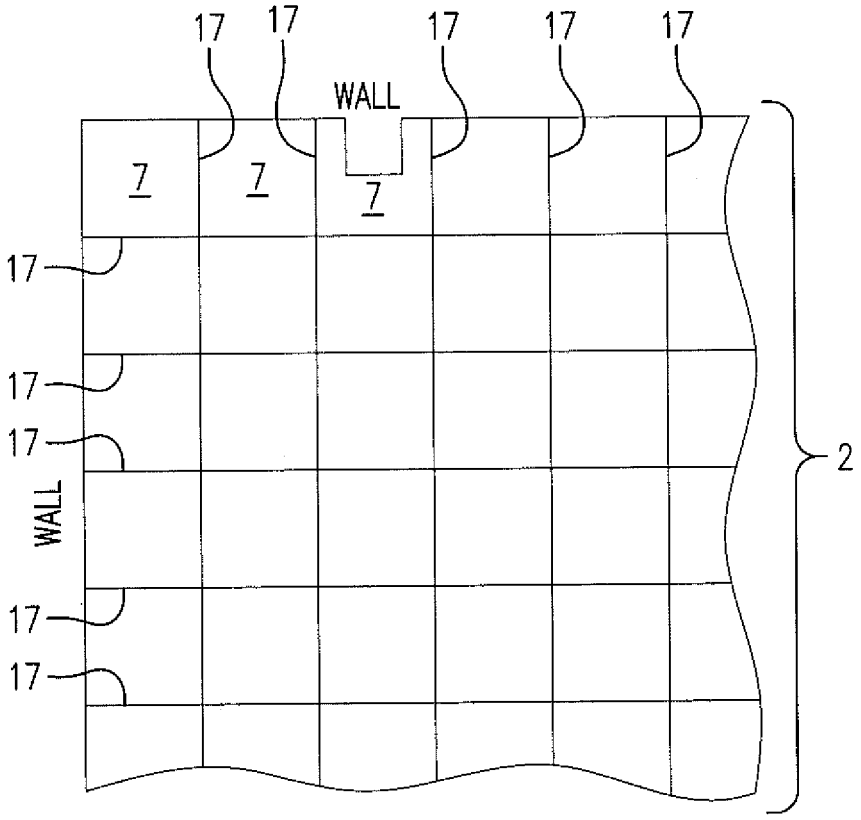
FIG. 9 is a line drawing of a portion of an embodiment of the multi-element flooring diaphragm of the present invention, with the self-spacing surface elements in a checkerboard pattern; self-spacing surface elements

As a first example of the pattern and placement of self-spacing surface elements in a multi-element flooring diaphragm in accordance with the reminder of the invention outlined herein, FIG. 9 is a schematic drawing of a portion of a multi-element flooring diaphragm layer of the composite flooring system of the present invention using square self-spacing surface elements as shown in FIG. 3. In this embodiment of the multi-element flooring diaphragm, the self-spacing surface elements are shown placed in a checkerboard pattern. The dotted lines show the placement of four flexible adhesive support cushions beneath each full self-spacing surface element, and the cutting of the multi-element flooring diaphragm and the remainder of the composite flooring system into a corner is also shown, along with a notch cut around a pillar or other obstacle, shown for demonstrative purposes.

Figure 10:
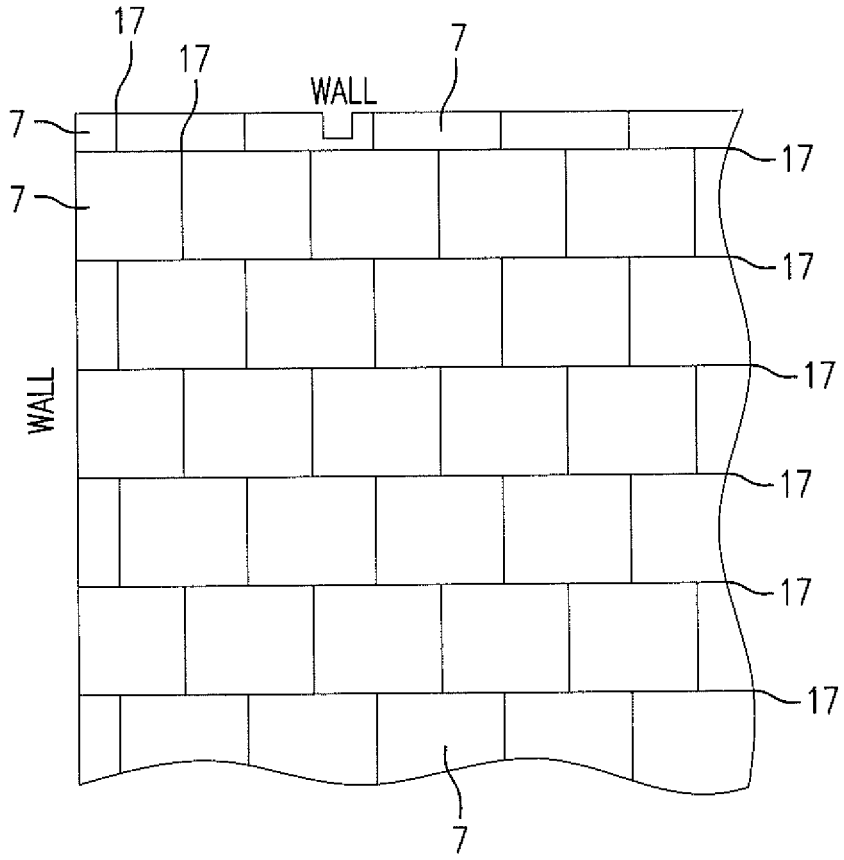
FIG. 10 is a line drawing of a portion of an embodiment of the multi-element flooring diaphragm of the present invention, with the self-spacing surface elements in a staggered pattern.

FIG. 10 demonstrates a schematic top view of the placement of self-spacing surface elements in a portion of an alternate embodiment of a multi-element flooring diaphragm layer of the composite flooring system—unlike the checkerboard pattern shown in FIG. 9, the embodiment of FIG. 10 shows the self-spacing surface elements placed in a staggered pattern. The same outer wall and corner configuration of FIG. 9 is shown for comparative purposes.

Figure 11:
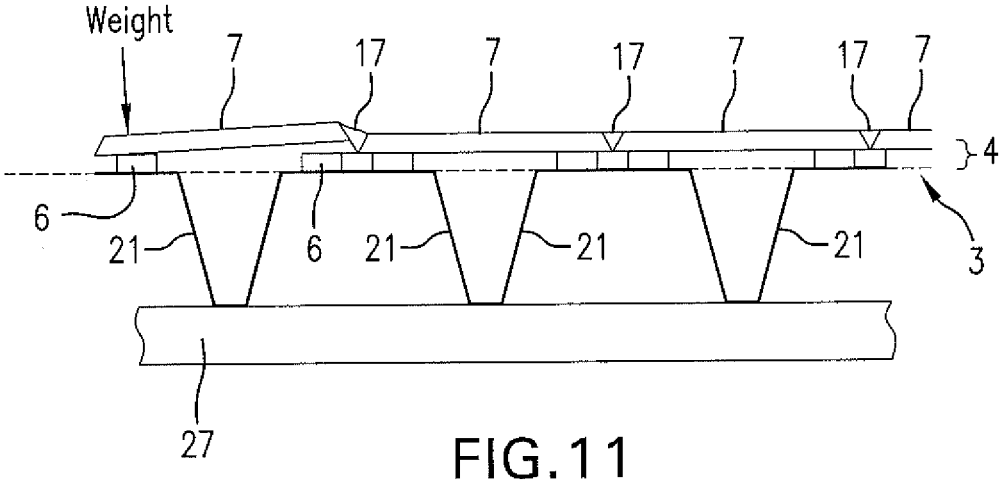
FIG. 11 is a cutaway side view of the composite flooring system of FIG. 1, demonstrating the loading and independent movement of the self-spacing surface elements; self-spacing surface elements

FIG. 11 shows a cross-sectional view of the composite flooring system of FIG. 8, demonstrating the independent movement of the self-spacing surface elements 7 under weight load.

The present disclosure also provides a method of construction of a composite flooring system comprising a multi-element flooring diaphragm supported above a substantially planar semi-rigid substrate surface with an air space of a defined thickness therebetween, said multi-element flooring diaphragm comprising a plurality of self-spacing surface elements, each self-spacing surface element having an upper surface with an upper outer edge therearound, a lower surface with a lower outer edge therearound, and outer edge surfaces extending between the lower outer edge and the upper outer edge of each side of said self-spacing surface element, and wherein for each lower outer edge of the self-spacing surface element which abuts an adjacent self-spacing surface element, the outer edge surfaces extending from said lower outer edge to the upper outer edge of the self-spacing surface element are beveled on an angle inwards towards the center of the self-spacing surface element such that an adhesive joint channel with a v-shaped cross-section is created between the outer edge surfaces of the adjacently positioned self-spacing surface elements; a plurality of flexible adhesive support cushions adhesively engaging the lower surface of each self-spacing surface element and the semi-rigid substrate surface, flexibly supporting the self-spacing surface elements above the semi-rigid substrate surface at the desired thickness of the air space; and flexible surface joints between all of the adjacent self-spacing surface elements, comprising flexible adhesive joint material applied into each adhesive joint channel; wherein individual self-spacing surface elements are capable of independent movement upon the application of various loads to the multi-element flooring diaphragm without breaching the surface integrity of the multi-element flooring diaphragm.

Figure 12:
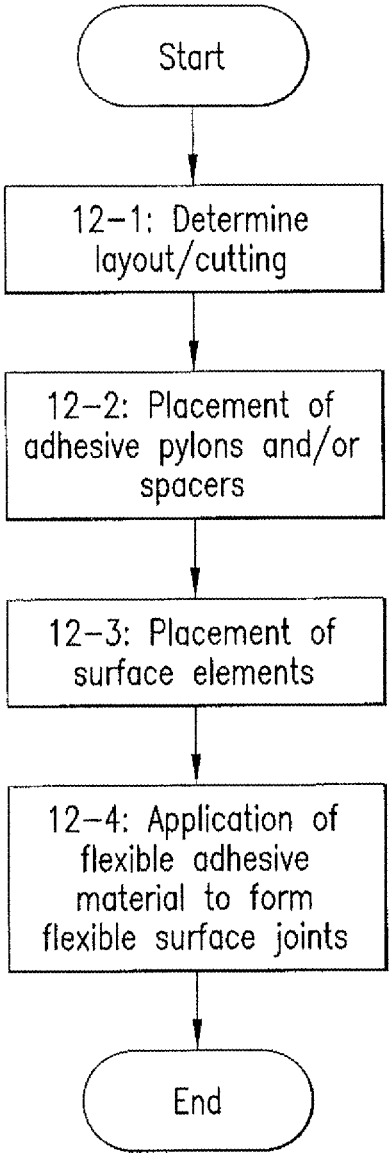
FIG. 12 is a flowchart illustrating the steps in one embodiment of the method of the present invention, where the multi-element flooring diaphragm is installed on a pre-existing semi-rigid substrate surface.

FIG. 12 is a flowchart demonstrating the steps in one embodiment of the method of the present invention. The method demonstrated in the flowchart of FIG. 12 represents the construction of the composite flooring system of the present invention on a pre-existing semi-rigid substrate surface.

In the method of FIG. 12 the remainder of the composite flooring system would be constructed on a pre-existing semi-rigid substrate surface. The first step in the method, shown at 12-1, consists of determining the placement of the plurality of self-spacing surface elements on the semi-rigid substrate surface. It is necessary to determine where the individual self-spacing surface elements or rows of self-spacing surface elements will be placed, to determine the appropriate placement of the flexible adhesive support cushions on the semi-rigid substrate surface. Part of the determination of the positioning of the self-spacing surface elements could also be the cutting of the self-spacing surface elements to fit any abnormalities in the installation location. Once the self-spacing surface elements have been cut to fit the installation location or the semi-rigid substrate surface and their locations have been determined, the next step in the method can be triggered.

The next step in the method, shown at 12-2, comprises the placement or application of flexible adhesive support cushions to the semi-rigid substrate surface in positions effective to support the plurality of self-spacing surface elements above the semi-rigid substrate surface. As outlined above with respect to the description of the composite flooring system, the application of the flexible adhesive support cushions comprises the application of the desired adhesive material to form the flexible adhesive support cushions to the semi-rigid substrate surface, such that the self-spacing surface elements can subsequently be placed thereon. In certain embodiments of the method and the composite flooring system, the application of the flexible adhesive support cushions might also include the placement of a plurality of spacers on the semi-rigid substrate surface, which are of the desired thickness to create an air space of the desired thickness. Placement of a plurality of spacers on the semi-rigid substrate surface will allow for the enforced thickness of the air space as the self-spacing surface elements are placed to form the multi-element flooring diaphragm.

The next step in the method, shown at 12-3, is the positioning the plurality of self-spacing surface elements on the semi-rigid substrate surface, with the lower surface of the self-spacing surface elements each adhesively engaging the flexible adhesive support cushions and supporting the self-spacing surface elements above the semi-rigid substrate surface at the desired thickness of the air space, and wherein by abutting the lower outer edge of adjacent self-spacing surface elements, flexible surface joints are created therebetween.

Following the placement of the self-spacing surface elements, Step 12-4 comprises applying flexible adhesive joint material into each adhesive joint channel to form flexible surface joints. The flexible adhesive joint material can be applied by injecting the flexible adhesive joint material with a gun or similar tool, or it could be manually or physically placed. Following the creation of the flexible surface joints, the adhesive of the flexible surface joints and the flexible adhesive support cushions can be allowed to set, at which time the composite flooring system is completed. Upon setting of the flexible adhesive support cushions and the flexible surface joints, individual self-spacing surface elements can move independently on the application of loads to the multi-element flooring diaphragm without breaching the surface integrity of the multi-element flooring diaphragm.

Figure 13:
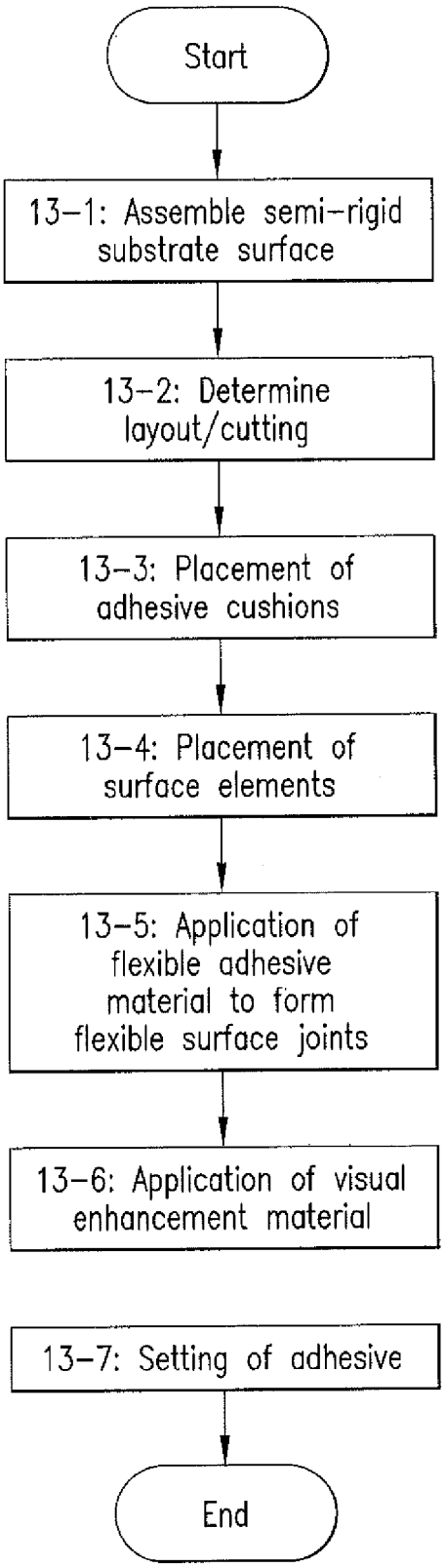
FIG. 13 is a flowchart outlining the steps of an alternate embodiment of the method of the present invention, in which the semi-rigid substrate surface is constructed in place as the first step in the method.

FIG. 13 is a flowchart demonstrating the steps in an alternate embodiment of the method of the present invention, in which the semi-rigid substrate surface is constructed in the location of the finished composite flooring system in advance of the installation of the multi-element flooring diaphragm. Shown at step 13-1 is the construction of the semi-rigid substrate surface—this would comprise either the construction of a modular substrate system or placement of at least one sheet of substrate layer material, as outlined elsewhere above. Following the construction of the semi-rigid substrate surface in the desired location, the next steps in the method can be completed. The following steps in the embodiment of the method shown in FIG. 13 equate to the first number of steps of the method shown in FIG. 12—namely the determination of placement and/or cutting of any of the self-spacing surface elements, shown at 13-2, placement of the flexible adhesive support cushions on the semi-rigid substrate surface (and any spacers if a plurality of spacers is to be used) Step 13-2. Following placement of the flexible adhesive support cushions, the self-spacing surface elements are placed on the semi-rigid substrate surface, shown at step 13-4, resulting in the initial formation of the multi-element flooring diaphragm. Following the assembly of the multi-element flooring diaphragm by placement of the plurality of self-spacing surface elements, the flexible adhesive joint material comprising the plurality of flexible surface joints will be applied into the adhesive joint channels between all of the adjacent self-spacing surface elements. Placement of the flexible adhesive joint material is shown at Step 13-5.

Shown next at Step 13-6 is the application of the visual enhancement material to the tacky flexible adhesive joint material comprising the flexible surface joints to alter the changed visual appearance of the flexible surface joints, for example to simulate grout or other cementitious material or the like. This would result in finished flexible surface joints like those shown in FIG. 6. Following the setting of the adhesive, the composite flooring system manufactured of the method of FIG. 13 would be complete.

Figure 14:
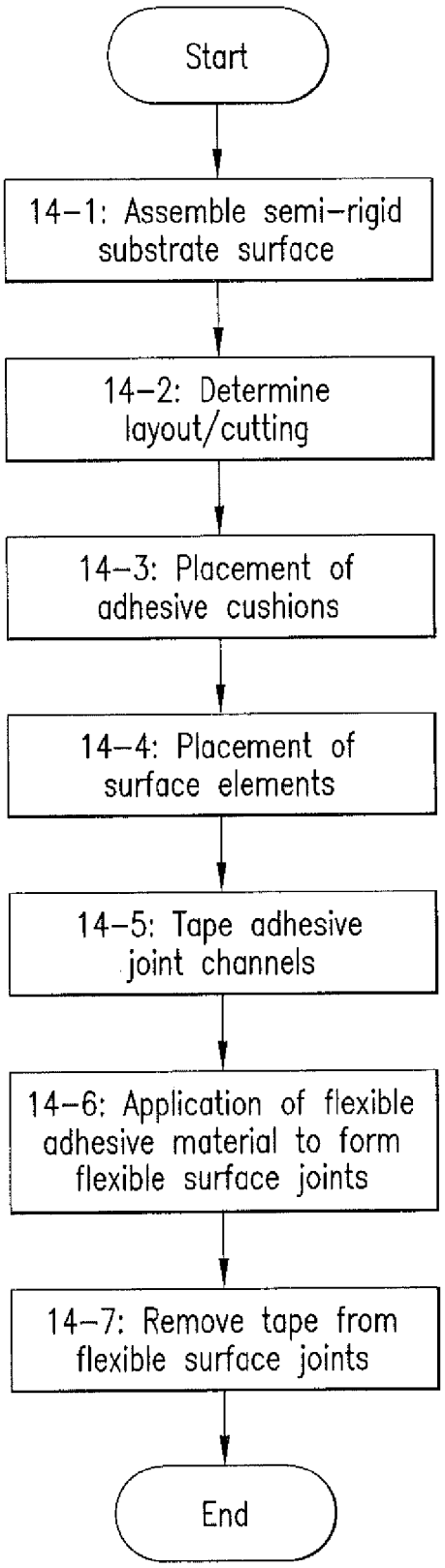
FIG. 14 is a flowchart demonstrating the steps in an alternate embodiment of the method of the present invention, in which the adhesive joint channels are taped in advance of the placement of the flexible adhesive joint material, and visual enhancement material is placed on the finished flexible surface joints. adhesive joint channel

Yet another embodiment of the method of the present invention is shown in FIG. 14—in this embodiment of the method the adhesive joint channels are taped in advance of the application of the flexible adhesive joint material. The first four steps of the method of this Figure, steps 14-1 through 14-4, are the same as the first four steps of the embodiment shown in FIG. 13. Following placement of the self-spacing surface elements, removeable tape could be applied along the adhesive joint channels defined by the adjacent self-spacing surface elements to save the upper surfaces of the self-spacing surface elements from marring with flexible adhesive joint material, and keep the overall surface of the multi-element flooring diaphragm clean. In alternative embodiments, the tape or similar guard might be applied to the upper outer edge of the self-spacing surface elements in advance of their placement onto the flexible adhesive support cushions. Application of the tape to the upper outer edges of the self-spacing surface elements is shown at Step 14-5. The application of the flexible adhesive joint material to form the flexible surface joints is shown at Step 14-6.

As shown, Step 14-7 shows the removal of the removeable tape from the surface of the multi-element flooring diaphragm is shown. Following the setting of the flexible adhesive joint material, the composite flooring system would be complete.

The self-spacing surface elements as well as the semi-rigid substrate surface and the modular substrate system, as well as the flexible adhesive joint material and the adhesive material used to form the flexible adhesive support cushions which might be used in the method of the present invention might be any of the embodiments of those items as outlined elsewhere herein.

It will be recognized that the specific materials used in constructing the various components of the system described herein, are not considered to be limiting to the scope of the invention. Those of skill in the art will readily recognize and be able to select materials and components that will accomplish the objectives of the invention without requiring any inventive skill.

It should also be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A composite flooring system comprising a multi-element flooring diaphragm supported above a substantially planar semi-rigid substrate surface with an air space of a predetermined thickness therebetween, wherein:

a) the semi-rigid substrate surface is a modular substrate system comprising a plurality of elongate substrate members configured to cooperatively form a substrate mounting surface for the adhesive attachment of flooring elements thereto, wherein:

i. each substrate member comprises a substantially flat upper surface, side surfaces meeting the upper surface in upper edges, and lateral flange portions at the distal ends of the side surfaces;

ii. each substrate member is substantially rigid along a longitudinal axis, but is torsionally flexible around the longitudinal axis; and iii. each lateral flange portion of each substrate member capable of holding said substrate member when placed in parallel alignment with an adjacent substrate member such that a substrate channel is defined therebetween;

iv. whereby when the modular substrate system is assembled the upper surfaces of the substrate members comprise the substrate mounting surface and the substrate channels run from one edge to the other of the substrate mounting surface alon the upper edges of the substrate members;

b) the multi-element flooring diaphragm comprises a plurality of self-spacing surface elements, each self-spacing surface element having an upper surface with an upper outer edge therearound, a lower surface with a lower outer edge therearound, and outer edge surfaces extending between the lower outer edge and the upper outer edge of each side of the self-spacing surface element, and wherein for each lower outer edge of the self-spacing surface element which abuts an adjacent self-spacing surface element, the outer edge surfaces extending from the lower outer edge to the upper outer edge of the self-spacing surface element are beveled on an angle inwards towards the center of the self-spacing surface element such that an adhesive joint channel having a v-shaped cross-section is formed between the outer edge surfaces of the adjacently positioned self-spacing surface elements;

c) a plurality of flexible adhesive support cushions are adhesively placed to engage the lower surface of each self-spacing surface element and the semi-rigid substrate surface, flexibly supporting the self-spacing surface elements above the semi-rigid substrate surface at the predetermined thickness of the air space; and d) flexible surface joints comprising flexible adhesive joint material being applied into each adhesive joint channel between all of the adjacent self-spacing surface elements; and wherein individual self-spacing surface elements are adapted to independently move upon the application of various loads to the multi-element flooring diaphragm without breaching the surface integrity of the multi-element flooring diaphragm.

2. The composite flooring system of claim 1, wherein the self-spacing surface elements include one or more of ceramic tile, concrete, fiber-reinforced concrete, natural stone and artificial stone.

3. The composite flooring system of claim 1, further comprising a plurality of spacers positioned between the self-spacing surface elements and the semi-rigid substrate surface to ensure adhesion of the self-spacing surface elements to the semi-rigid substrate surface with the predetermined air space.

4. The composite flooring system of claim 1, wherein the semi-rigid substrate surface comprises a pre-existing surface adapted to bond to the flexible adhesive support cushions.

5. The composite flooring system of claim 1, wherein the semi-rigid substrate surface comprises at least one sheet of substrate layer material applied over a pre-existing surface to form the substrate surface.

6. The composite flooring system of claim 5, wherein the at least one sheet of substrate layer material comprises a waterproof membrane.

7. The composite flooring system of claim 5, wherein the at least one sheet of substrate layer material comprises a semi-rigid sheet material.

8. The composite flooring system of claim 7, wherein the at least one sheet of substrate layer material is styrofoam.

9. The composite flooring system of claim 1, wherein the modular substrate system further comprises a support frame underneath the substrate layer.

10. The composite flooring system of claim 9, wherein the support frame further comprises risers that raise the height of the modular substrate system.

11. The composite flooring system of claim 1, further comprising visual enhancement material applied to the exposed upper surface of the flexible surface joints that alter the visual appearance of the multi-element flooring diaphragm.

12. The composite flooring system of claim 11, wherein the visual enhancement material comprises grit material that simulates the appearance of cementitious grout joints between the self-spacing surface elements.

13. The composite flooring system of claim 1, wherein the flexible adhesive joint material is substantially waterproof.

14. A method of construction of a composite flooring system comprising a multi-element flooring diaphragm supported above a substantially planar semi-rigid substrate surface with an air space of a predetermined thickness therebetween, wherein:

a) the substantially planar semi-rigid substrate surface is a modular substrate system made up of a plurality of elongate substrate members configured to cooperatively form a substrate mounting surface for the adhesive attachment of flooring elements thereto, wherein each substrate member comprises a substantially flat upper surface, side surfaces meeting the upper surface in upper edges, and lateral flange portions at the distal ends of the side surfaces, and each substrate member is substantially rigid along a longitudinal axis, but is torsionally flexible around the longitudinal axis, and each lateral flange portion of each substrate member capable of holding said substrate member when placed in parallel alignment with an adjacent substrate member such that a substrate channel is defined therebetween, whereby when the modular substrate system is assembled the upper surfaces of the substrate members comprise the substrate mounting surface and the substrate channels run from one edge to the other of the substrate mounting surface along the upper edges of the substrate members;

b) the multi-element flooring diaphragm comprises a plurality of self-spacing surface elements, each self-spacing surface element having an upper surface with an upper outer edge therearound, a lower surface with a lower outer edge therearound, and outer edge surfaces extending between the lower outer edge and the upper outer edge of each side of said self-spacing surface element, and wherein for each lower outer edge of the self-spacing surface element which abuts an adjacent self-spacing surface element, the outer edge surfaces extending from said lower outer edge to the upper outer edge of the self-spacing surface element are beveled on an angle inwards towards the center of the self-spacing surface element such that an adhesive joint channel with a v-shaped cross-section is created between the outer edge surfaces of the adjacently positioned self-spacing surface elements;

c) a plurality of flexible adhesive support cushions are adhesively placed to engage the lower surface of each self-spacing surface element and the semi-rigid substrate surface, flexibly supporting the self-spacing surface elements above the semi-rigid substrate surface at the desired thickness of the air space; and d) flexible surface joints comprising flexible adhesive joint material are applied into each adhesive joint channel between all of the adjacent self-spacing surface elements; wherein individual self-spacing surface elements are capable of independent movement upon the application of various loads to the multi-element flooring diaphragm without breaching the surface integrity of the multi-element flooring diaphragm;

the method comprising the steps of:

determining the placement of the plurality of self-spacing surface elements on the semi-rigid substrate surface;

applying a plurality of adhesive flexible support cushions to the semi-rigid substrate surface in positions effective to support the plurality of self-spacing surface elements above the semi-rigid substrate surface;

positioning the plurality of self-spacing surface elements on the semi-rigid substrate surface, with the lower surface of the self-spacing surface elements each adhesively engaging the flexible adhesive support cushions and supporting the self-spacing surface elements above the semi-rigid substrate surface at the desired thickness of the air space, and wherein by abutting the lower outer edge of adjacent self-spacing surface elements, adhesive joint channels are created therebetween; and applying flexible adhesive joint material into each adhesive joint channel to form flexible surface joints;

wherein upon setting of the flexible adhesive support cushions and the flexible surface joints, individual self-spacing surface elements are adapted to move independently upon the application of loads to the multi-element flooring diaphragm without breaching the surface integrity of the multi-element flooring diaphragm.

15. The method of claim 14, wherein the flexible adhesive support cushions are formed from an elastic or elastomeric material.

16. The method of claim 14, further comprising the step of placing a plurality of spacers on the semi-rigid substrate surface following placement of the flexible adhesive support cushions that ensure the proper spacing of the self-spacing surface elements from the semi-rigid substrate surface when adhering them to the flexible adhesive support cushions.

17. The method of claim 14, wherein the semi-rigid substrate surface comprises a pre-existing surface adapted to bond to the adhesive flexible adhesive support cushions.

18. The method of claim 14, wherein the semi-rigid substrate surface is constructed in advance of the assembly of the composite flooring system, and the method further comprises the step of installation of the semi-rigid substrate surface in the finished location of the composite flooring system in advance of the determination of placement of the self-spacing surface elements.

19. The method of claim 18, wherein the semi-rigid substrate surface comprises at least one sheet of substrate layer material applied over a pre-existing surface to form the substrate surface.

20. The method of claim 19, wherein the at least one sheet of substrate layer material comprises a waterproof membrane.

21. The method of claim 19, wherein the at least one sheet of substrate layer material comprises a semi-rigid sheet material.

22. The method of claim 21, wherein the at least one sheet of substrate layer material is styrofoam.

23. The method of claim 14, wherein the lateral flange portions of the substrate members are configured to engage lateral flange portions of adjacent substrate members.

24. The method of claim 14, wherein the modular substrate system further comprises a support frame underneath the substrate layer, and the step of assembly of the modular substrate system further comprises the assembly of the support frame.

25. The method of claim 24, wherein the support frame further comprises risers that raise the height of the modular substrate system.

26. The method of claim 14, wherein the self-spacing surface elements comprise one or more of ceramic tile, concrete, fiber-reinforced concrete, natural stone and artificial stone.

27. The method of claim 14, further comprising the step of applying visual enhancement material to the exposed upper surface of the flexible adhesive joint material following the application of the flexible adhesive joint material that alters the visual appearance of the completed multi-element flooring diaphragm.

28. The method of claim 27, wherein the visual enhancement material is grit material that simulates the appearance of cementitious grout joints between the self-spacing surface elements.

* * * * *